US011932433B2

(12) United States Patent
Derendinger

(10) Patent No.: US 11,932,433 B2
(45) Date of Patent: Mar. 19, 2024

(54) GASSING APPARATUS AND METHOD FOR GASSING A CONTAINER

(71) Applicant: Ferrum Packaging AG, Schafisheim (CH)

(72) Inventor: Philippe Derendinger, Hägendorf (CH)

(73) Assignee: FERRUM PACKAGING AG, Schafisheim (CH)

( * ) Notice: Subject to any disclaimer, the term of this patent is extended or adjusted under 35 U.S.C. 154(b) by 0 days.

(21) Appl. No.: 17/790,076

(22) PCT Filed: Jan. 15, 2020

(86) PCT No.: PCT/EP2020/050851
§ 371 (c)(1),
(2) Date: Jun. 29, 2022

(87) PCT Pub. No.: WO2021/144011
PCT Pub. Date: Jul. 22, 2021

(65) Prior Publication Data
US 2023/0053801 A1 Feb. 23, 2023

(51) Int. Cl.
*B65B 31/04* (2006.01)

(52) U.S. Cl.
CPC ..... *B65B 31/046* (2013.01); *B65B 31/043* (2013.01)

(58) Field of Classification Search
CPC .... B65B 31/046; B65B 31/043; B65B 31/041
See application file for complete search history.

(56) References Cited

U.S. PATENT DOCUMENTS 2,330,598 A * 9/1943 Kronquest ..... B65B 31/00 141/70
2,693,305 A * 11/1954 Boyd ..... B65B 31/00 141/70

(Continued)

FOREIGN PATENT DOCUMENTS

CN 108799821 A 11/2018
DE 102017207260 A1 * 10/2018 ..... B65B 31/041

OTHER PUBLICATIONS

International Search Report dated Oct. 12, 2020 in corresponding European Application No. PCT/EP2020/050851.

*Primary Examiner* — Andrew M Tecco
*Assistant Examiner* — Nicholas E Igbokwe
(74) *Attorney, Agent, or Firm* — GLOBAL IP COUNSELORS, LLP

(57) ABSTRACT

A gassing device for gassing a container includes a rotatable gassing rotor with a container receptacle for receiving the container and a feeding area for feeding a gas via a feed opening. The container receptacle includes a gassing nozzle flow-connected to the feed opening via a channel for gassing the container, and a stationary gas supply with a stationary supply opening arranged on the feeding area such that the supply opening can be flow-connected to the feed opening. The gassing rotor can be supplied with the gas from the gas supply in the operating state by moving the feed opening to the stationary supply opening by rotating the gassing rotor. The feeding area is connected without contact to the gas supply in the form of a labyrinth seal, so that the gassing rotor is rotatable relative to the gas supply in the operating state.

15 Claims, 6 Drawing Sheets

(56) References Cited

U.S. PATENT DOCUMENTS

| | | | | | |
|---|---|---|---|---|---|
| 2,993,457 | A * | 7/1961 | Geeson | B21D 51/32 | 413/32 |
| 3,545,160 | A * | 12/1970 | Scott | B65B 31/00 | 53/403 |
| 4,729,204 | A * | 3/1988 | Weiss | B65B 31/00 | 53/88 |
| 2018/0297792 | A1 * | 10/2018 | Triebel | B65B 7/2857 | |

* cited by examiner

GASSING APPARATUS AND METHOD FOR GASSING A CONTAINER

CROSS-REFERENCE TO RELATED APPLICATION

This application is a U.S. National Stage application of International Application No. PCT/EP2020/050851, filed Jan. 15, 2020, the contents of which are hereby incorporated by reference.

BACKGROUND

Field of the Invention

The present disclosure relates to a gassing device for gassing a container, to a sealer having a gassing device and to a method for gassing a container.

Background Information

It is known from the state of the art to seal cans using a lid to produce a sealed can. In this case, these can be cans in which, for example, a food product is arranged; often the food product is a beverage such as beer.

When sealing the can, a lid is often separated from a stack of lids and conveyed to a sealer such as a can seaming machine by a lid receiving device. Subsequently, the lid is placed on an opening of the can and is essentially firmly attached to the can, for example by seaming. Such a device and such a method are known, for example, from U.S. Pat. No. 2,840,963.

In addition, it is known that, at least during a section of the supply of the lid to the container sealing device, to convey a gas, such as an inert gas, to an underside of the lid; the gas is conveyed substantially parallel to the underside of the lid. When used as intended, this underside faces the opening of the can. Thus, it can be ensured that a residual volume of the can, in which no food is arranged, is essentially filled with the gas before sealing, whereby the air originally present in the residual volume is displaced as completely as possible by the gas. In this way, if necessary, a longer shelf life can be achieved for the food arranged in the can.

For the supply of gas, a gassing device for at least one container in a sealer is often used, by which gas can be conveyed to the underside of a lid or to an opening of the container. For this purpose, the gassing device has a channel for the gas, which leads the gas flow through baffles in a gassing rotor of the gassing device to a gassing nozzle at a container receptacle of the gassing device. The gas is fed into the rotatable gassing rotor from a stationary gas supply.

SUMMARY

It has been determined that the known state of the art has the disadvantage that the gas supply to the rotatable gassing rotor is arranged in a grinding/frictional contact with each other, which can lead to wear on the gas supply and the gassing rotor. In addition, there is a permanent need to gas the containers more efficiently and to ensure hygienic sealing of the containers.

It is therefore an object of the present disclosure to avoid the disadvantages known from the state of the art, in particular to provide an efficient, hygienic and low-wear gassing device.

These objects are met by the gassing device for gassing a container, the sealer with the gassing device according to the present disclosure and the method for gassing the container according to the present disclosure.

The present disclosure relates to a gassing device for gassing a container with a rotatable gassing rotor having a container receptacle for receiving the container and a lid and with a feeding area for feeding a gas via a feed opening into the gassing rotor. The container receptacle has a gassing nozzle which is flow-connected to the feed opening of the feeding area via a channel for gassing the container. In addition, the gassing device comprises a stationary gas supply with a stationary supply opening, which stationary supply opening is arranged on the feeding area in such a way that the supply opening can be flow-connected to the feed opening. The gassing rotor can therefore be supplied with the gas from the gas supply in the operating state by moving the feed opening to the stationary supply opening by rotating the gassing rotor, whereby the feed opening is flow-connected to the supply opening. The gassing device according to the invention is characterized in that the feeding area (i.e. the gassing rotor) is connected without contact to the gas supply in the form of a labyrinth seal, so that the gassing rotor is rotatable relative to the gas supply in the operating state.

In particular, the gas can be an inert gas such as nitrogen ($N_2$), carbon dioxide ($CO_2$), a noble gas or any combination of these gases. In a particularly important embodiment of the invention, the gas is carbon dioxide and the container is a beverage can or the gas is nitrogen and the container is a food can.

In practice, the gas supply can comprise a groove and the feeding area can comprise a web arranged in the groove of the gas supply, which are connected without contact in the form of the labyrinth seal. As an alternative, the feeding area can comprise a groove and the gas supply can comprise a web arranged in the groove of the feeding area, which are connected without contact in the form of the labyrinth seal. Preferably, the labyrinth seal is therefore formed by at least one web, which is arranged in at least one groove. A (thin), usually U-shaped gap is thus formed between the web and the groove. The sealing effect is based on the extension of a flow path through the gap to be sealed, whereby the flow resistance of the gas is considerably increased. The extension of the path through the gap is achieved by the engagement of groove and web. This means that there is an interlocking of the rotatable gassing rotor and the stationary gas supply by the labyrinth seal. In practice, the feeding area can also comprise a plurality of grooves and webs which are arranged (interlocked) in respective grooves and webs of the gas supply. With a larger number of grooves and webs, the sealing effect can be increased, but the labyrinth seal is then also more difficult to clean.

The feeding area is preferably arranged at a rotation center of the gassing rotor. In practice, a shaft rotatable about an axis can be arranged in the rotation center for rotating the gassing rotor, which shaft is connected to the gassing rotor in a torque-proof manner. Particularly preferred, the web (and also the groove) extend parallel to the axis of rotation (respectively to the shaft). In particular, the web is a circular web and the groove is a circular groove.

The channel can be arranged in an interior of the gassing rotor. In addition, the channel can be designed in such a way that it forms the shortest distance between the feed opening and the gassing nozzle. Preferably, the channel is essentially formed by baffles inside the gassing rotor, which extend along the flow direction of the gas (i.e. in particular in a radial direction to the axis of rotation).

In a preferred embodiment, the gassing rotor comprises a plurality of container receptacles with gassing nozzles, wherein the gassing nozzles are flow-connected to the feeding area via the respective feed openings. In principle, each gassing nozzle can therefore be flow-connected to the supply opening via the respective channel, for which purpose each gassing nozzle is flow-connected to a respective feed opening. The container receptacles are preferably arranged along a circumference of the, in particular round, gassing rotor and are arranged at regular intervals to each other, for example. In particular, the gassing rotor can be designed as a gassing star or a round plate.

Particularly preferred, the gas supply can comprise a nozzle ring with a ring opening. The ring opening is arranged on the supply opening in such a way that the supply opening can be selectively flow-connected to at least one of the feed openings via the ring opening by moving the at least one feed opening to the ring opening by rotating the gassing rotor in the operating state, whereby the feed opening is flow-connected to the ring opening and thus is flow-connected to the supply opening. This means that only a single container can be selectively gassed, while the other containers at the other container receptacles are not yet gassed, but only when their respective feed opening is flow-connected with the ring opening. Of course, no nozzle ring is required for this purpose, in principle, only a single container can be selectively gassed by flow-connecting the feed opening to the supply opening, while the other containers at the other container receptacles are not yet gassed, but only when their respective feed opening is flow-connected to the supply opening (by rotating the gassing rotor). However, if the ring opening is larger than the feed opening such that the ring opening extends along the circumference of the nozzle ring over several feed openings, (at least) two feed openings can also be flow-connected to the ring opening simultaneously. This can serve to pre-gas a container receptacle/a lid before the container is guided with its opening to the lid, or to pre-gas the container receptacle before the container is picked up. A similar effect could be achieved without a nozzle ring with a supply opening that extends over several (e.g. two) feed openings. The ring opening or the extension of the supply opening allows the gas flow only in a certain/predeterminable segment of the gassing rotor.

In an embodiment of the invention, the feed openings can be arranged in a circle, wherein the nozzle ring is arranged at the feed openings (above the feed openings) in such a way that the feed openings are closed/covered by the nozzle ring so that only the feed opening which is arranged at the ring opening is flow-connected to the supply opening. By rotating the gassing rotor, another feed opening is moved to the ring opening.

In practice, the gassing rotor preferably comprises a container supply for supplying containers to the container receptacle and a container discharge for discharging a gassed container from the container receptacle. By rotating the gassing rotor, the container is transported from the container receptacle to the container discharge, whereby the container is gassed and preferably a lid is applied to the opening of the container. In addition, the container discharge usually leads to a sealing device for sealing the container with the lid.

The gassing device can comprise a cleaning system, which is arranged on the labyrinth seal for cleaning the labyrinth seal in such a way that a cleaning fluid can be supplied to the labyrinth seal in the operating state. For this purpose, a gas for example as cleaning fluid can be supplied to the labyrinth seal and/or the feed opening by the cleaning system, or separate cleaning channels can be provided to introduce a liquid cleaning fluid, for example.

The gas supply can in particular be designed as a cover with a gas pipe, which cover is arranged around the shaft and on the gassing rotor above the feeding area. The cleaning channels can preferably be arranged in the cover and lead from a cleaning fluid supply of the cleaning system between the gas supply and the gassing rotor.

As cleaning fluids are suitable among others chlorine dioxide, ECA based disinfectants, foam cleaners, in particular foam cleaners comprising amine oxides and phosphoric acid, alcohols and other disinfectants.

The present disclosure further relates to a sealer for the container, in particular a can sealer, comprising a lid supply device for supplying a lid to the container, the gassing device according to the disclosure for supplying gas to the container and a sealing device for sealing the container with the lid. In practice, the container is gassed when it is received by the container receptacle of the gassing rotor and the lid is disposed above the container. Subsequently, the container with the lid on the lid opening is brought to the sealing device and is sealed there. In particular, the container is a can which is seamed with the lid in the sealing device in a known manner.

An additional aspect of the present disclosure relates to a method for gassing the container. The method comprises the following steps:

- Providing the gassing device according to the invention;
- Receiving a container by the container receptacle;
- Moving the feed opening to the supply opening by rotating the gassing rotor;
- Feeding the gas from the gas supply into the gassing rotor;
- Gassing the container from the gassing nozzle of the gassing rotor.

As mentioned above, the container is then introduced into the sealing device together with the lid and is sealed there. The lid is usually arranged on the container receptacle before the container is received.

BRIEF DESCRIPTION OF THE DRAWINGS

The invention will be explained in more detail hereinafter with reference to the drawings.

DETAILED DESCRIPTION

Figure 1:
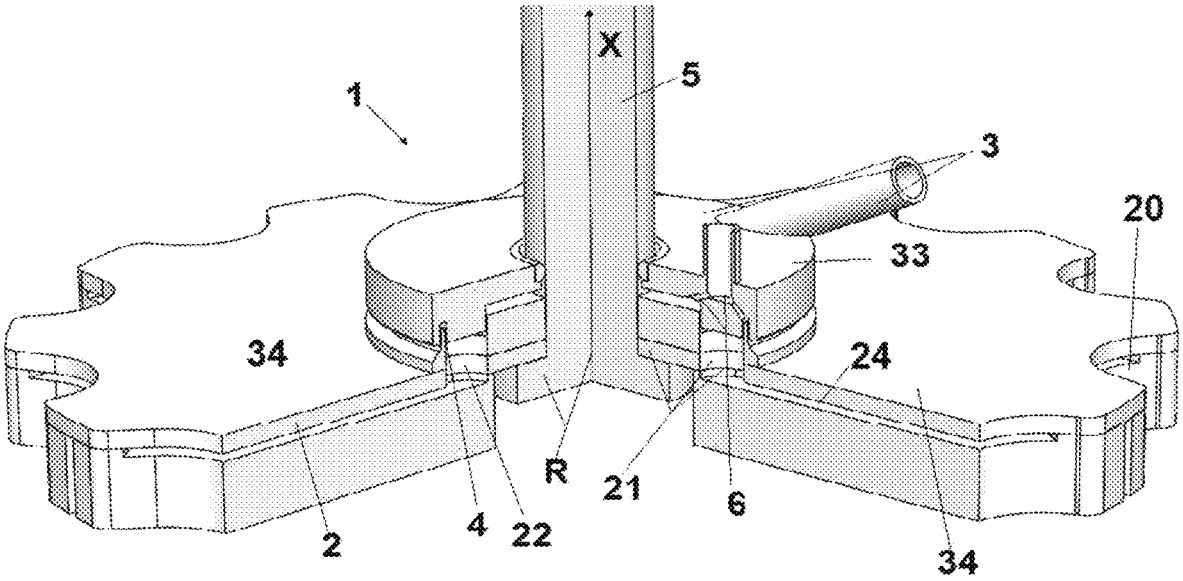
FIG. 1 illustrates a first perspective view of the gassing device according to the invention.

FIG. 1 shows a perspective view of the gassing device 1 according to the present disclosure. The gassing device 1 for gassing a container comprises a rotatable gassing rotor 2, which is connected to the shaft 5 in a torque-proof manner and can be rotated about the axis X by rotating the shaft 5 in the operating state.

Figure 3:
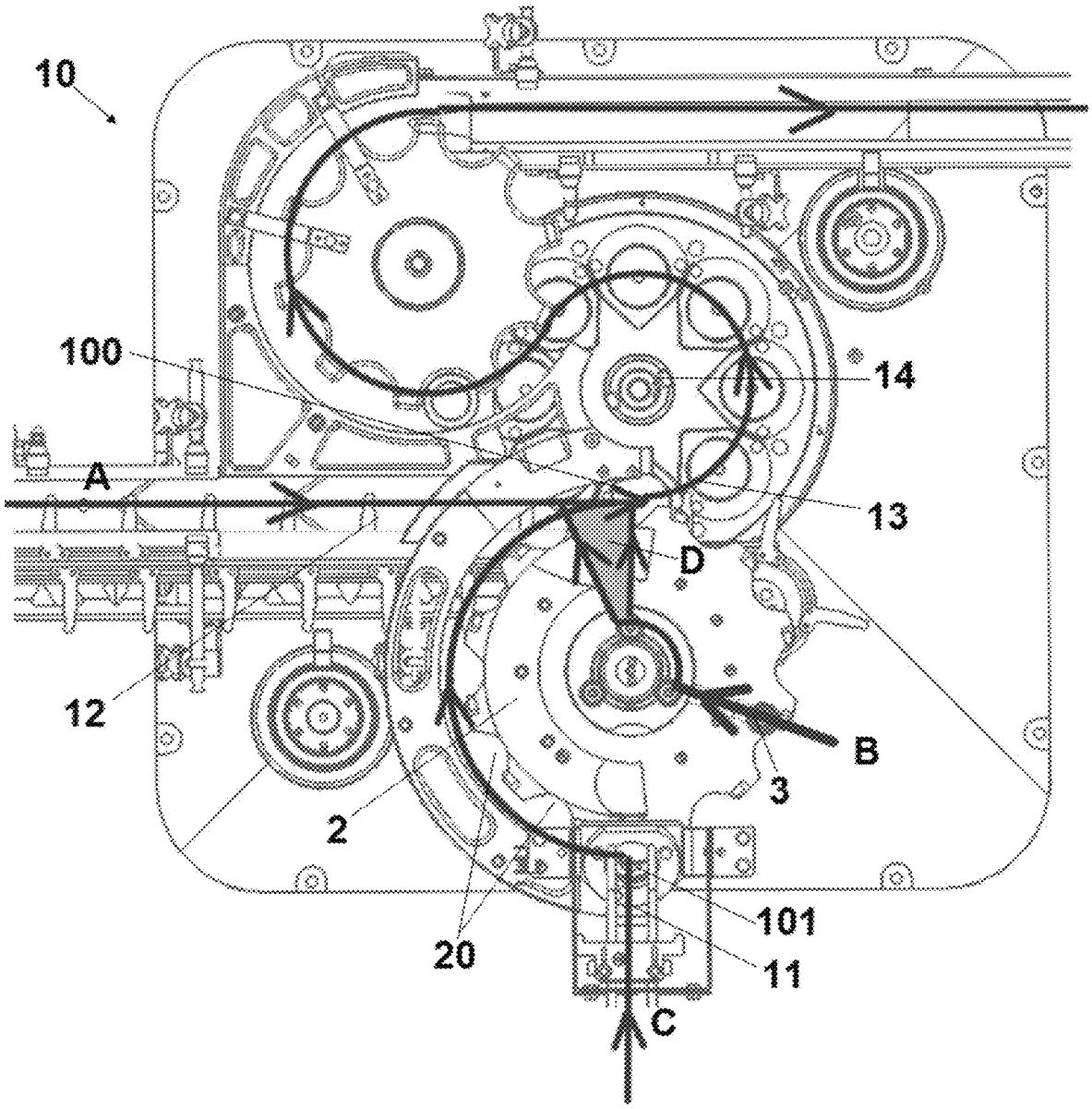
FIG. 3 illustrates a plan view on a sealer according to the invention.
Figure 6:
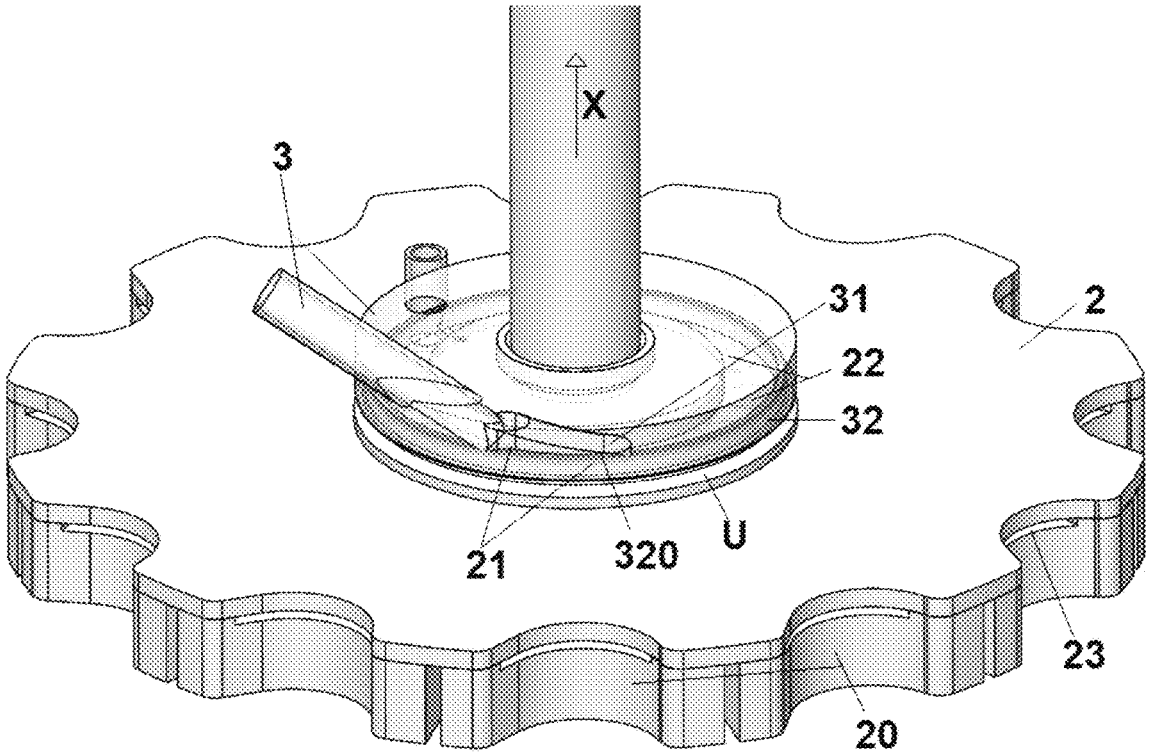
FIG. 6 illustrates a further perspective view of the gassing device according to the invention.

The gassing rotor 2 comprises a container receptacle for receiving the container, which is also represented in FIGS. 3 and 6 with the reference sign 20.

The gassing rotor 2 has a feeding area 21 for feeding a gas via a feed opening 22 into the gassing rotor 2. The feeding area 21 is located at the rotation center R, in which the shaft 5 is also arranged.

The container receptacle 20 according to FIGS. 3 and 6 comprises a gassing nozzle 23, which gassing nozzle 23 is flow-connected to the feed opening 22 of the feeding area 21 via a channel 24 for gassing the container.

Figure 4:
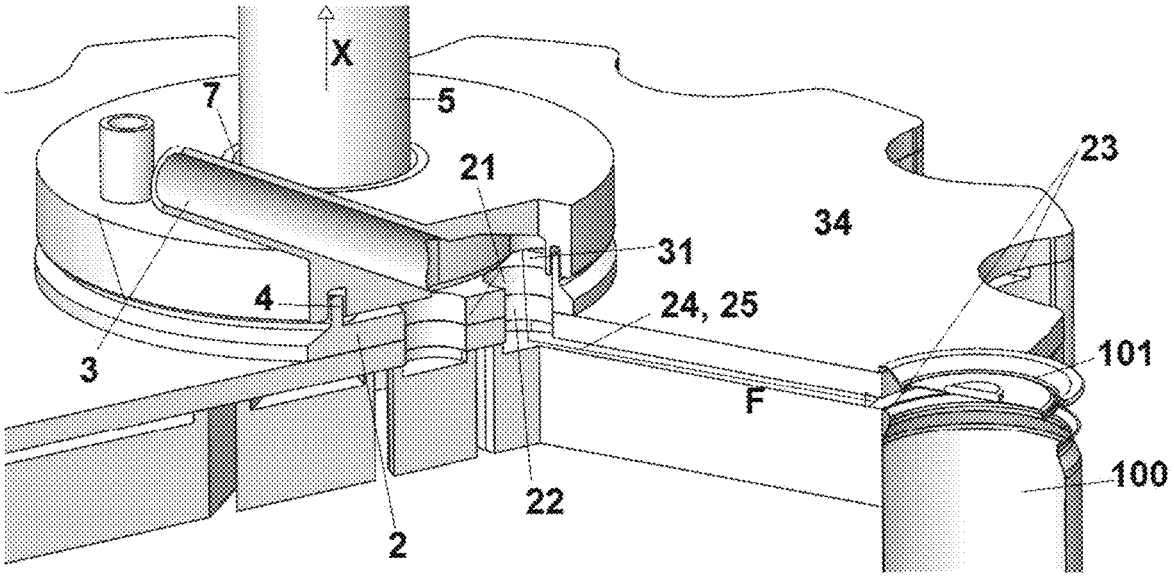
FIG. 4 illustrates a sectional view of a further embodiment of the gassing rotor according to the invention.

In addition, the gassing device 1 comprises a stationary gas supply 3 with a stationary supply opening (represented as 31 in FIGS. 4 and 6), which stationary supply opening 31 is arranged on the feeding area 21 in such a way that the supply opening 31 can be flow-connected to the feed opening 21. The gassing rotor 2 can be supplied with the gas from the gas supply 3 in the operating state by moving the feed opening 22 to the stationary supply opening 31 by rotating the gassing rotor 2 about the axis X, whereby the feed opening 22 is flow-connected to the supply opening 31. In FIG. 4, the feed opening 22 is flow-connected to the supply opening 31. The supply opening can also be regarded as a supply chamber 31.

The feeding area 21 is connected without contact to the gas supply 3 in the form of a labyrinth seal 4, so that the gassing rotor 2 is rotatable relative to the gas supply 3 in the operating state. In the represented embodiment, the gas supply is arranged like a kind of cover 33 around the shaft 5 and on the gassing rotor 2 above the feeding area 21. A strong outflow of the gas from the gassing device as well as a grinding/rubbing contact of the gassing rotor 2 and the gas supply 3 is avoided by the labyrinth seal 4.

Absolute tightness is not necessary with the non-contact labyrinth seal 4 according to the present disclosure. In particular, a slight surface gas flow from the labyrinth seal 4 to the surface 34 of the gassing rotor 2, as well as to a periphery of the gassing rotor (at which the container receptacles are arranged, usually along a circumference of the gassing rotor) can be achieved there to create a gas atmosphere at the container of the container receptacle. Carbon dioxide is particularly preferred as a gas and creates a $CO_2$ atmosphere in a beverage container like a can.

The gassing device 1 according to FIG. 1 additionally comprises a cleaning system 6, which is arranged on the labyrinth seal 4 for cleaning the labyrinth seal 4 in such a way that a cleaning fluid can be supplied to the labyrinth seal 4 in the operating state. The shown embodiment of the labyrinth seal 4 has the advantage for the combination with the cleaning system 6 that no sump of cleaning fluid can form in the labyrinth seal 4, but that the cleaning fluid can simply drain off. The cleaning system 6 is described in FIG. 5 in more detail.

Figure 2:
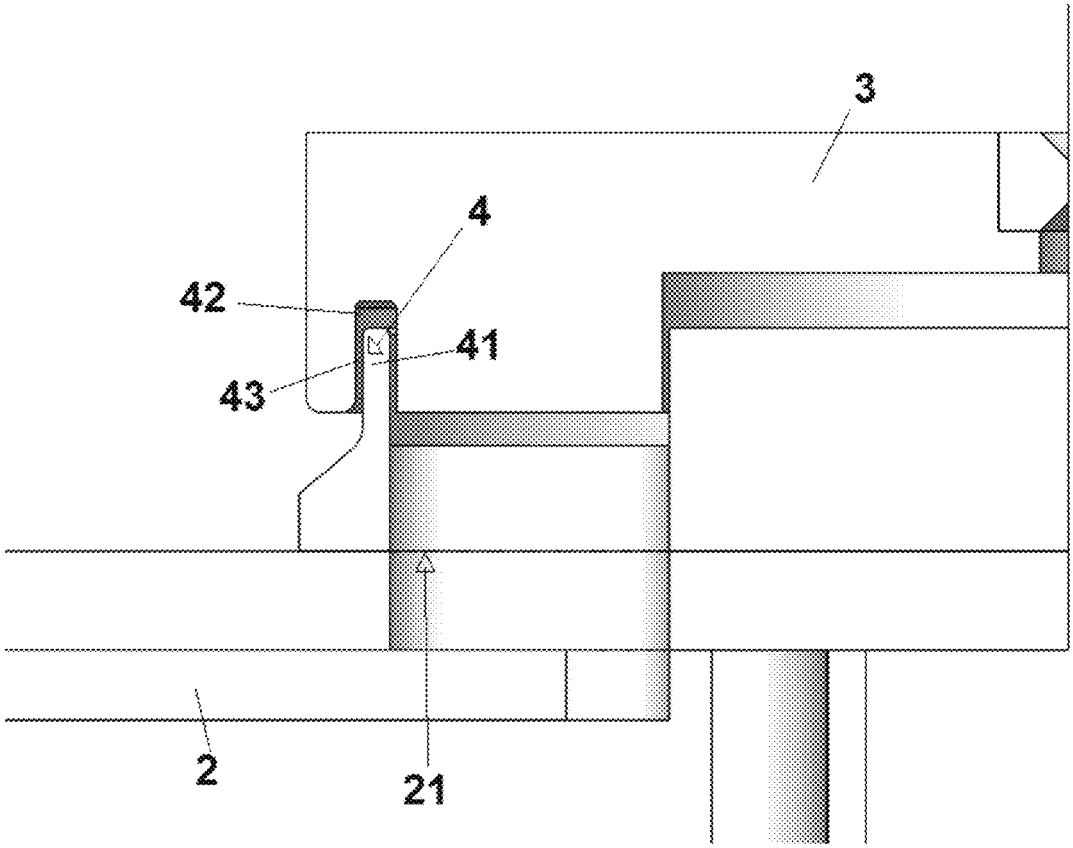
FIG. 2 illustrates a first sectional view of the gassing rotor according to the invention according to FIG. 1.

FIG. 2 shows a first sectional view of the gassing rotor 2 according to the disclosure, in which the section of the gassing rotor 2 with the labyrinth seal 4 is represented.

The labyrinth seal 4 is designed as follows. The gas supply 3 comprises a groove 42 and the feeding area 21 comprises a web 41 arranged in the groove 42. The web 41 and the groove 42 are connected without contact in the form of a labyrinth seal 4, i.e. the web 41 is arranged in the groove 42 in such a way that a (thin) gap 43 is formed between the two. The sealing effect is based on the extension of a flow path through the gap 43, whereby a flow resistance is considerably increased. The extension of the path through the gap 43 is achieved by the engagement of groove 42 and web 41. This means that there is an interlocking of the rotatable gassing rotor 2 and the stationary gas supply 3 by the labyrinth seal 4.

In principle, the feeding area could comprise a plurality of grooves and webs, which are arranged (interlocked) in respective grooves and webs of the gas supply. The sealing effect can be increased with a larger number of grooves and webs. However, cleaning the labyrinth seal is made more difficult and the advantageous surface gas flow from the labyrinth seal 4 via the surface 34 described above is reduced.

The web 41 and the groove 42 extend parallel to the axis X (to the shaft 5) of rotation. The web is designed as a circular web and the groove as a circular groove.

FIG. 3 shows a plan view on the sealer 10 according to the present disclosure.

The sealer 10 for the container 100 comprises a lid supply device 11 for supplying the lid 101 to the container 100, a gassing device 1 according to the present disclosure for supplying gas to the container 100, and a sealing device 14 for sealing the container 100 with the lid 101.

In the embodiment shown, the sealer 10 is preferably designed as a can sealer 10. The container 100 is a can, which is seamed in the sealing device 14, which is designed as a can seaming machine 14. Carbon dioxide or nitrogen is the preferred gas to be supplied to the cans.

In the operating state, the lid 101 is introduced into the sealer 10 along the arrow C by the lid supply device 11. Here, the lids 101 are arranged on the gassing rotor 2. The lids 101 are transported further by rotating the gassing rotor 2 about the axis X. Then, the containers 100 are introduced into the container receptacles 20 of the gassing rotor 2 by the container supply 12. There the container 100 is gassed with the gas such as carbon dioxide or nitrogen and combined with the lid 101.

The gassing is performed by moving the feed opening 22 to the supply opening 31 by rotating the gassing rotor 2, so that a feed of the gas from the gas supply 3 to the gassing rotor 2 is possible. The gas supply is effected along the arrow B from the gas supply 3 into the gassing rotor 2. The gas from the gassing nozzle 23 of the gassing rotor 2 is supplied to the container 100. A whole area D can preferably be gassed by means of an annular groove (as described in FIG. 6) instead of gassing only a single container.

The gassing rotor 2 comprises a plurality of container receptacles 20 with gassing nozzles 23, whereby the gassing nozzles 23 are flow-connected to the feeding area 21 via the respective feed openings 22.

The container is transported by the container discharge 13 from the gassing device 1 to the sealing device 14.

FIG. 4 shows a sectional view of a further embodiment of the gassing rotor 2 according to the present disclosure.

The stationary supply opening 31 is arranged on the feeding area 21. In the configuration shown, the supply opening 31 is arranged above the feed opening 22 and is thus flow-connected to the feed opening 22.

The gas can be supplied to the gassing rotor 2 from the gas supply 3 along arrow D. There is therefore a gas flow along arrow F, which leads from the supply opening 31 of the gas supply 3 into the feed opening 22 of the gassing rotor 2. In the gassing rotor 2, the gas flows through the channel 24 in the interior 25 of the gassing rotor 2 to the gassing nozzle 23, where the container 100 is applied with the gas. However, a part of the gas atmosphere of the container 100 is also formed by the gas flowing from the labyrinth seal 4 in the form of surface gas flow over the surface 34 of the gassing rotor to the container 100 and the lid 101.

The feeding area 21 is connected without contact to the gas supply 3 in the form of a labyrinth seal 4, so that the gassing rotor 2 is rotatable relative to the gas supply 3 in the operating state. The labyrinth seal 4 corresponds to the embodiment according to FIG. 2.

In the embodiment according to FIG. 4, the gas supply 3 is also sealed against the shaft 5 by a shaft seal 7.

Figure 5:
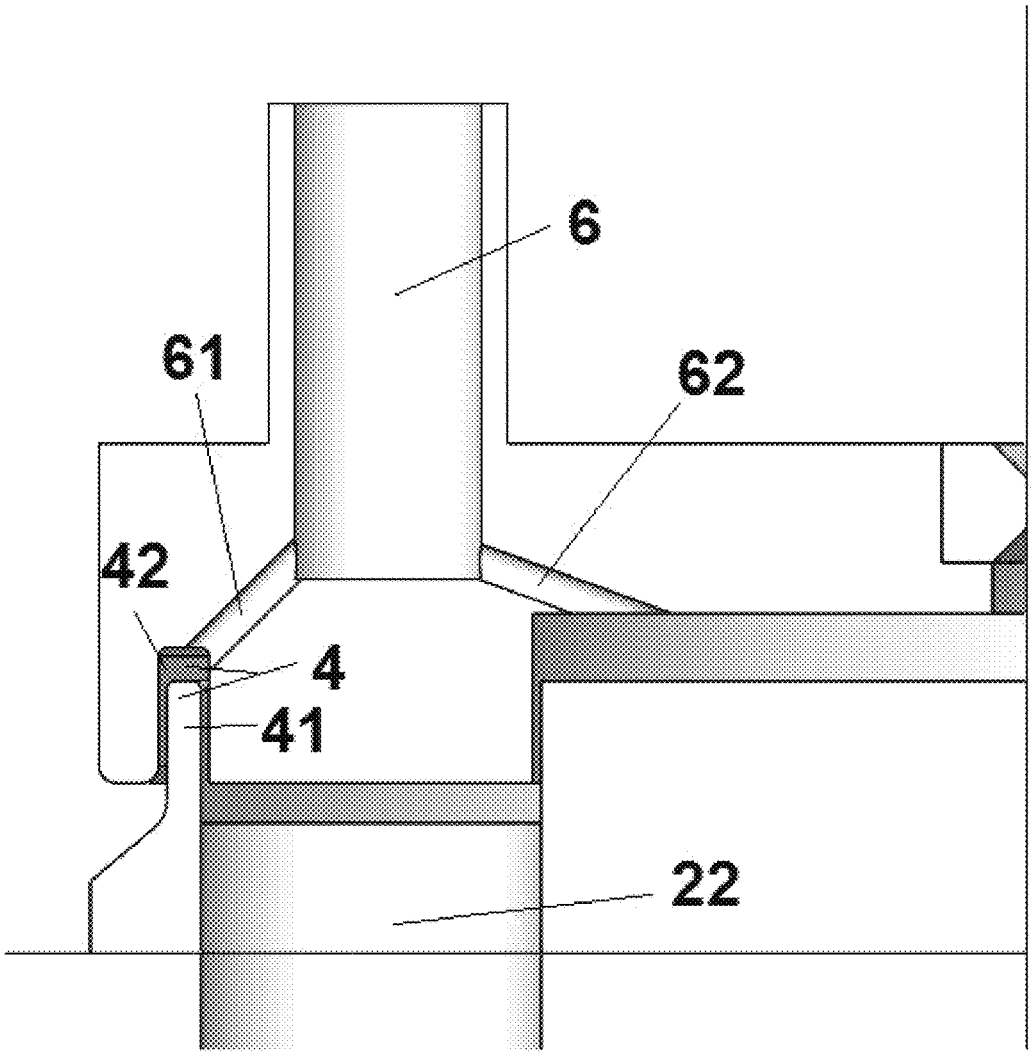
FIG. 5 illustrates a second sectional view of the gassing rotor according to the invention according to FIG. 1.

FIG. 5 shows a second sectional view of the gassing rotor 1 according to the embodiment illustrated in FIG. 1.

The cleaning system 6 comprises cleaning channels 61 and 62, which are arranged on the labyrinth seal 4 in such a way that a cleaning fluid in the form of a liquid or the gas for gassing the containers can be supplied to the labyrinth seal 4 for cleaning the labyrinth seal 4 in the operating state. The shown embodiment of the labyrinth seal 4 with web 41 and groove 42 (described in more detail in FIG. 2) has the advantage in combination with the cleaning system 6 that no sump of cleaning fluid can form in the labyrinth seal 4, but that the cleaning fluid can simply drain off. In this way, a hygienic cleaning of the labyrinth seal 4 and the device according to the invention is enabled.

Furthermore, the cleaning system could also be used as (additional) gas supply, whereby the surface gas flow over the surface 34 could be increased by the cleaning channel 61 to increase the gas atmosphere around the containers.

FIG. 6 shows a further perspective view of the gassing device 1 according to the present disclosure.

The gassing rotor 1 comprises a plurality of container receptacles 20 with gassing nozzles 23, which are flow-connected to the feeding area 21 and their respective feed openings 22 via a channel.

Furthermore, the gas supply 3 comprises a nozzle ring 32 with a ring opening 320. The ring opening 320 is arranged on the supply opening 31 in such a way that the feeding area 21 can be selectively flow-connected to at least one of the feed openings 22 via the ring opening 320 by moving the at least one feed opening 22 to the ring opening 320 by rotating the gassing rotor 2 about the axis X in the operating state, whereby the feed opening 22 is flow-connected to the ring opening 320. If the feed opening 22 is flow-connected with the ring opening 320, it is also flow-connected to the gas supply 3 and the supply opening 31. The supply opening 31 functions as an annular groove 31 and in this embodiment could also be regarded as a supply chamber, which is arranged at least partially at, in particular above the nozzle ring 32 in the gas supply 3.

For example, only one single container can be selectively gassed, while the other containers at the other container receptacles 20 are not yet gassed, but only when their respective feed opening 22 is flow-connected with the ring opening 320.

The ring opening 320 is designed so larger than the feed opening 22 that the ring opening 320 extends along the circumference U of the nozzle ring 32 over several feed openings 22. In this way, (at least) two feed openings 22 can be flow-connected simultaneously with the ring opening 320. In this way, one feed opening 22 can be pre-gassed, while the container is gassed at another feed opening 22.

A similar effect can be achieved without nozzle ring 32 with a supply opening 31, which extends over several (e.g. two) feed openings 22. The ring opening 320 or the extension of the supply opening 31 allows the gas flow only in a certain/predeterminable segment (D in FIG. 3) of the gassing rotor 3.

The invention claimed is:

1. A gassing device for gassing a container, comprising:

a rotatable gassing rotor with a container receptacle configured to receive the container and with a feeding area configured to feed a gas via a feed opening into the gassing rotor, the container receptacle comprising a gassing nozzle flow-connected to the feed opening of the feeding area via a channel to gas the container; and a stationary gas supply with a stationary supply opening arranged on the feeding area such that the supply opening is capable of being flow-connected to the feed opening, the gassing rotor configured to be supplied with the gas from the gas supply in an operating state by moving the feed opening to the stationary supply opening by rotating the gassing rotor, the feed opening flow-connected to the supply opening, the feeding area connected without contact to the gas supply by a labyrinth seal, so that the gassing rotor is rotatable relative to the gas supply in the operating state; and a cleaning system arranged on the labyrinth seal to clean the labyrinth seal such that a cleaning fluid is capable of being supplied to the labyrinth seal in the operating state.

2. The gassing device according to claim 1, wherein the gas supply comprises a groove and the feeding area comprises a web arranged in the groove, the web and the groove connected without contact to form the labyrinth seal.

3. The gassing device according to claim 1, wherein the feeding area comprises a groove and the gas supply comprises a web arranged in the groove, the groove and the web connected without contact to form the labyrinth seal.

4. The gassing device according to claim 1, wherein the feeding area is arranged at a rotation center of the gassing rotor.

5. The gassing device according to claim 4, wherein a shaft rotatable about an axis is arranged in the rotation center to rotate the gassing rotor and is connected to the gassing rotor in a torque-proof manner.

6. The gassing device according to claim 1, wherein the channel is arranged in an interior of the gassing rotor.

7. The gassing device according to claim 1, wherein the container receptacle is one of a plurality of container receptacles, each container receptacle of the plurality of container receptacles, having a gassing nozzle, each of the gassing nozzles flow-connected to the feeding area via a respective feed opening.

8. The gassing device according to claim 7, wherein the gas supply comprises a nozzle ring with a ring opening, the ring opening is arranged on the supply opening such that the feeding area is configured to be selectively flow-connected to at least one of the feed openings via the ring opening by moving the at least one feed opening to the ring opening by rotating the gassing rotor in the operating state, whereby the feed opening is flow-connected to the ring opening.

9. The gassing device according to claim 1, wherein the gassing rotor is a round plate.

10. The gassing device according to claim 1, comprising a container supply configured to supply the container to the container receptacle and a container discharge for discharging a gassed container with a lid from the container receptacle.

11. The gassing device according to claim 1, wherein the cleaning system comprises a first cleaning channel arranged on the labyrinth seal so that the cleaning fluid is capable of being supplied to the labyrinth seal in the operating state.

12. The gassing device according to claim 11, wherein the cleaning system comprises a second cleaning channel arranged at the feed opening such that the cleaning fluid is capable of being supplied to the feed opening in the operating state.

13. A sealer for a container, comprising:

a lid supply device configured to supply a lid to the container;

the gassing device according to claim 1 to supply gas to the container; and a sealing device configured to seal sealing the container with the lid.

14. A method for gassing a container, comprising:

providing a gassing device according to claim 1;

receiving the container by the container receptacle;

moving the feed opening to the supply opening by rotating the gassing rotor;

feeding the gas from the gas supply into the gassing rotor; and gassing the container from the gassing nozzle of the gassing rotor.

15. The sealer for a container according to claim 13, wherein the sealer is a can sealer.

* * * * *